US008938980B2

(12) United States Patent
Boarman et al.

(10) Patent No.: US 8,938,980 B2
(45) Date of Patent: Jan. 27, 2015

(54) INTEGRATED ICE MAKER PUMP

(75) Inventors: Patrick J. Boarman, Evansville, IN (US); Brian K. Culley, Evansville, IN (US); Gregory Gene Hortin, Henderson, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 188 days.

(21) Appl. No.: 13/594,030

(22) Filed: Aug. 24, 2012

(65) Prior Publication Data

US 2014/0053578 A1 Feb. 27, 2014

(51) Int. Cl.
*F25C 1/00* (2006.01)

(52) U.S. Cl.
USPC ..... 62/66; 62/340

(58) Field of Classification Search
CPC ..... F25C 5/005; F25C 1/10; F25C 1/04; F25C 2400/14
USPC ..... 62/66, 72, 340, 353
See application file for complete search history.

(56) References Cited

U.S. PATENT DOCUMENTS

| | | | | |
|---|---|---|---|---|
| 3,451,227 | A | 10/1967 | Jacobs | |
| 3,827,249 | A * | 8/1974 | Garland et al. | 62/174 |
| 3,839,983 | A | 10/1974 | McAusland | |
| 3,873,289 | A * | 3/1975 | White | 62/149 |
| 4,755,957 | A * | 7/1988 | White et al. | 702/184 |
| 5,297,944 | A | 3/1994 | Pomeroy | |
| 5,329,780 | A * | 7/1994 | Broadbent | 62/72 |
| 6,065,302 | A * | 5/2000 | Sada et al. | 62/324.4 |
| 6,185,953 | B1 * | 2/2001 | Sada et al. | 62/324.4 |
| 6,250,084 | B1 * | 6/2001 | Sato et al. | 62/3.64 |
| 6,435,849 | B1 | 8/2002 | Guilmette | |
| 6,951,113 | B1 | 10/2005 | Adamski | |
| 2004/0131482 | A1 | 7/2004 | King | |
| 2009/0260371 | A1 | 10/2009 | Kuehl et al. | |
| 2010/0064704 | A1 | 3/2010 | Feinauer et al. | |
| 2010/0251730 | A1 * | 10/2010 | Whillock, Sr. | 62/3.63 |
| 2012/0167596 | A1 * | 7/2012 | Krause et al. | 62/3.2 |

FOREIGN PATENT DOCUMENTS

| | | | |
|---|---|---|---|
| CN | 1100195 | A | 3/1995 |
| CN | 1114410 | A | 1/1996 |
| JP | 2005066315 | | 3/2005 |
| WO | 2009010424 | A2 | 1/2009 |
| WO | 2011124440 | A1 | 10/2011 |

OTHER PUBLICATIONS

Abstract of JP 10-62044 to Takeuchi W.*

* cited by examiner

*Primary Examiner* — Mohammad M Ali

(57) ABSTRACT

A refrigerator includes a refrigerator cabinet, an ice maker disposed within the refrigerator cabinet, a pump fluidly connected to the ice maker and configured for pumping cooling media to the ice maker, and a motor operatively connected to the ice maker and configured to provide oscillating movement to the ice maker. The pump is operatively connected to the motor such that driving of the motor results in the pumping of the cooling media with the pump.

18 Claims, 9 Drawing Sheets

INTEGRATED ICE MAKER PUMP

FIELD OF THE INVENTION

The present invention relates to refrigerators. More specifically, the present invention relates to an integrated ice maker pump for a refrigerator.

BACKGROUND OF THE INVENTION

One way of making clear ice involves rocking the ice maker while freezing the ice. One of the problems with such a method of making clear ice is that energy efficiency is lost. In such an ice maker, water must be supplied to the ice maker, and rocking motion must be supplied. In addition, and especially in the case where the ice maker is located remotely from the freezer compartment, cooling fluid must be circulated in order to freeze the water into ice. What is needed is an improved ice maker for a refrigerator with improved efficiency.

SUMMARY OF THE INVENTION

Therefore, it is a primary object, feature, or advantage of the present invention to improve over the state of the art.

It is a further object, feature, or advantage of the present invention to improve energy efficiency of an ice maker of a refrigerator.

It is a still further object, feature, or advantage of the present invention to use a single power source to provide both a rocking motion to an ice maker and pumping of cooling fluid.

One or more of these and/or other objects, features, or advantages of the present invention will become apparent from the specification and claims that follow. No single embodiment need exhibit each or all of these objects, features, or advantages as different embodiments may provide different objects, features, and advantages. The present invention is not to be limited by or to these objects, features, or advantages.

According to one aspect, a refrigerator includes a refrigerator cabinet, an ice maker disposed within the refrigerator cabinet, a pump fluidly connected to the ice maker and configured for pumping cooling media to the ice maker, and a motor operatively connected to the ice maker and configured to provide oscillating movement to the ice maker. The pump is operatively connected to the motor such that driving of the motor results in the pumping of the cooling media with the pump.

According to another aspect, a refrigerator is provided. The refrigerator includes a refrigerator cabinet, an ice maker disposed within the refrigerator cabinet, and an oscillation pump comprising a bladder, a first check valve and a second one way check valve and positioned such that oscillation of the icemaker compresses and relieves the bladder in a cyclical manner. Cooling media may be contained within the bladder. A cooling media reservoir may be fluidly connected to the bladder and a thermoelectric cooler or a cold sink may be in contact with the cooling media reservoir.

According to another aspect, a refrigerator is provided. The refrigerator ma include a refrigerator cabinet, an ice maker disposed within the refrigerator cabinet, an oscillation pump comprising a bladder in contact with the ice maker, a one way check valves associated with the bladder, and a cooling media reservoir fluidly connected to the bladder. The ice maker is configured to oscillate thereby compressing and relieving the bladder in a cyclical manner. The check valves and movement of the ice maker creates a circular flow of fluid in the bladder and moves fluid from the bladder to and from the cooling media reservoir.

According to another aspect, a method of using motion of an ice maker of a refrigerator to power flow of cooling media. The method includes providing a refrigerator having a refrigerator cabinet, an ice maker disposed within the refrigerator cabinet, and an oscillation pump comprising a bladder, a first check valve and a second one way check valve and positioned such that oscillation of the icemaker compresses and relieves the bladder in a cyclical manner. The method further includes using oscillation of the icemaker to power the flow of the cooling media by compressing and relieving the bladder to create a circular flow of the cooling media within the bladder.

According to yet another aspect, a refrigerator is provided. The refrigerator includes a refrigerator cabinet, an ice maker disposed within the refrigerator cabinet, a motor, a drive hub operatively connected to the motor, and a drive link between the drive hub and the ice maker such operation of the motor provides rocking movement to the ice maker. There may also be pump impeller operatively connected to the drive hub such that driving of the motor results in the pumping of the cooling media with the pump as well as fluid connections between the pump impeller and the ice maker for circulating cooling fluid.

According to yet another aspect, a refrigerator is provided. The refrigerator includes a refrigerator cabinet, an ice maker disposed within the refrigerator cabinet, a pump assembly, a drive impeller operatively connected to the pump assembly, a drive hub operatively connected to the drive impeller, a drive link between the drive hub and the ice maker such that operation of the pump assembly provides rocking movement to the ice maker, and fluid connections between the drive impeller and the ice maker for circulating cooling fluid.

DETAILED DESCRIPTION

Figure 1:
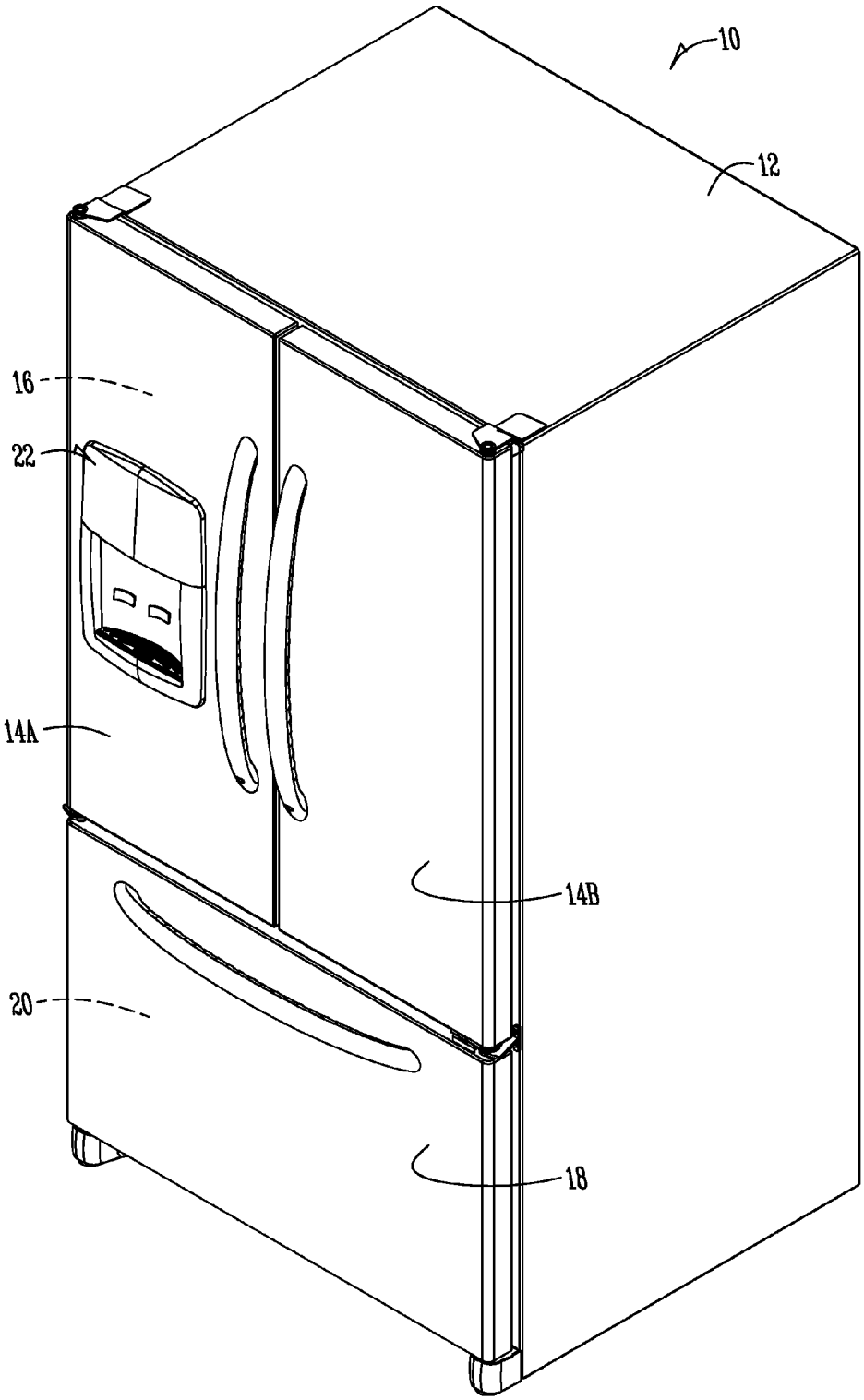
FIG. 1 illustrates a perspective view of one embodiment of a refrigerator with the ice maker of the present invention.

FIG. 1 illustrates one embodiment of a refrigerator 10 with the ice maker of the present invention. The refrigerator 10 has a cabinet 12 with French doors 14A, 14B providing access to a refrigerator compartment 16 and a bottom door or drawer 18 providing access to a freezer compartment 20. A water/ice dispenser 22 is present on one of the French doors 14A. Although a refrigerator with a bottom mount freezer and French doors is shown, the ice maker of the present invention may be used in other configurations of refrigerators.

Figure 2:
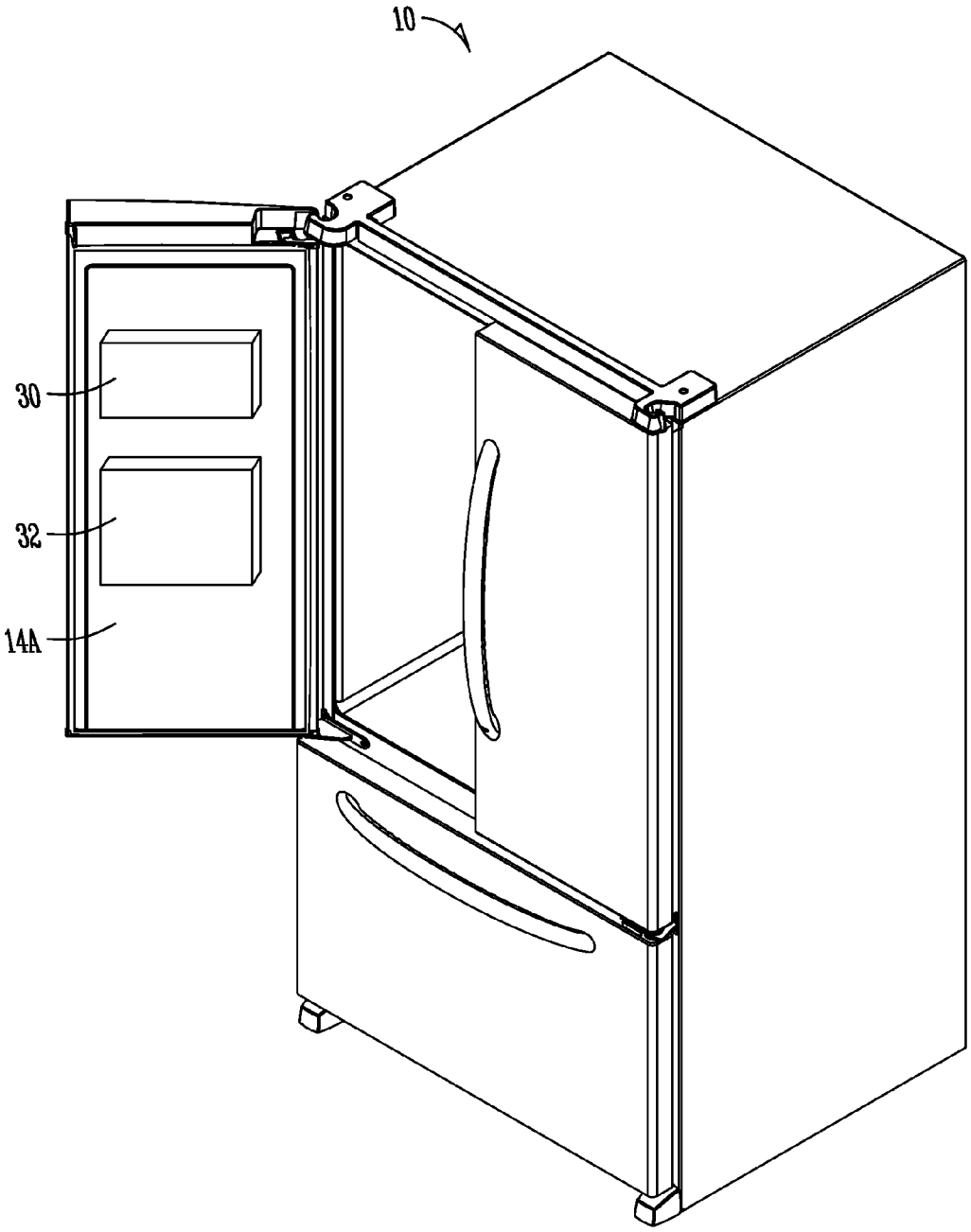
FIG. 2 illustrates the refrigerator with a French door open to show the ice maker.

FIG. 2 illustrates the refrigerator 10 with French door 14A open to show the ice maker 30 and an ice storage bin 32 positioned below the ice storage bin 32. The ice maker 30 need not be mounted in the location shown, but what is shown is one convenient location for the ice maker 30 and ice storage bin 32.

Figure 3:
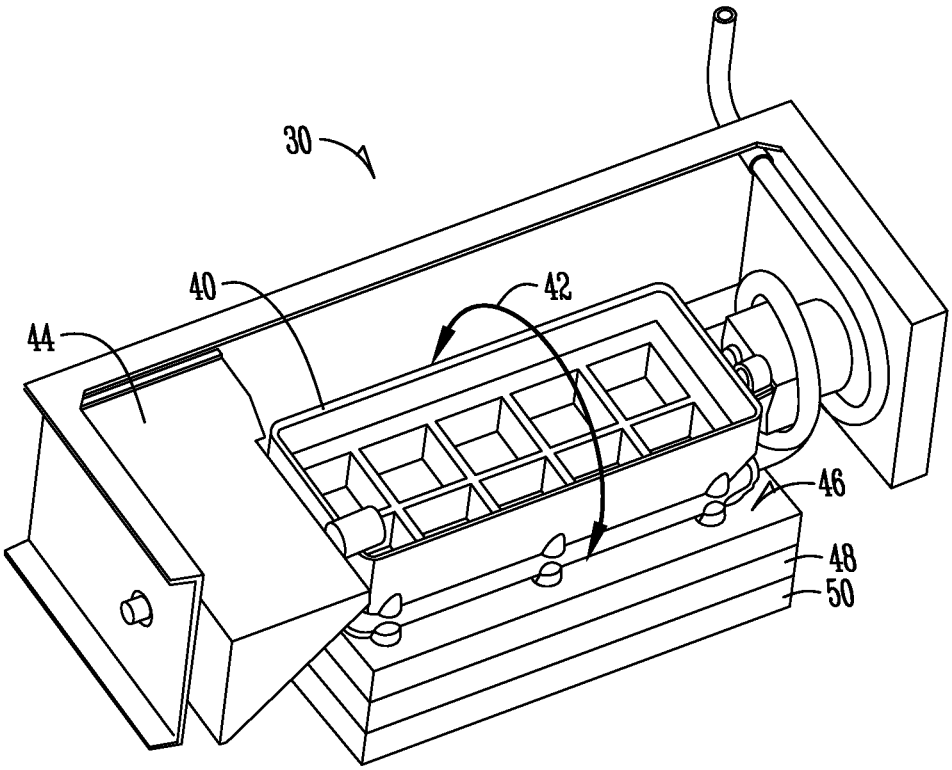
FIG. 3 illustrates one embodiment of an ice maker in greater detail.

FIG. 3 is a perspective view of one embodiment of an ice maker 30. The ice maker 30 has a tray 40 which may be rocked back and forth such as in the direction shown by arrow 42 while the ice maker 30 is freezing ice. A motor 44 may be used to provide the rocking or oscillating motion. A bladder pump 46 is positioned below the tray 40. The bladder pump 46 may be formed by providing a bladder pump 46 having a plurality of chambers 62, 64 with valves located between each chamber so that the fluid flow is directed to pass through the bladder pump 46 in a circular motion. In another embodiment a cooling media reservoir 48 is positioned outside of the bladder pump 46 and the fluid may additionally circulate through cooling media reservoir 48.

A thermoelectric cooler (TEC) or cold sink 50 may be positioned in thermal contact with the cooling media reservoir 46 to cool the cooling media which is circulated through the bladder pump 46 to freeze water into ice. The cooling media can be any number of different fluids. For example, the cooling media can be glycol, salt brine, water, or other solutions. Alternatively cold sink 50 could be in direct thermal contact with bladder pump 46. In yet another embodiment cooling media reservoir 48 could be in direct contact with bladder pump 46 or even integral with bladder pump 46. In still another embodiment cold sink 50 may be in thermal contact, either direct or indirect, with both bladder pump 46 and cooling media reservoir 48 or just with one of them.

Additionally one skilled in the art will appreciate that either bladder pump 46 or cold sink 50 could be cooled by other methods, including from air cooled by an evaporator, air from within a freezer or fresh food compartment, cooled by a compressor, or other similar methods or a combination of the foregoing.

Figure 4:
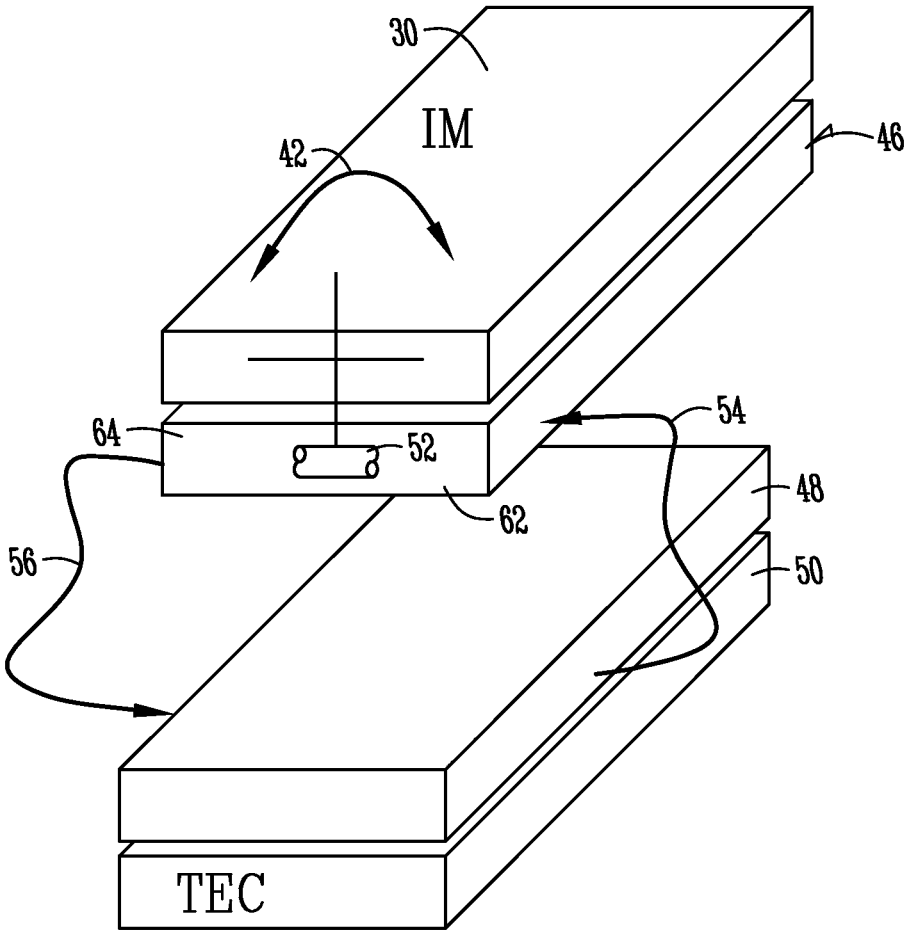
FIG. 4 illustrates an ice maker using a bladder pump.

FIG. 4 is a block diagram showing the use of the bladder pump 46. As shown in FIG. 4, the ice maker 30 is operatively connected to the bladder pump 46. The bladder pump 46 circulates cooling media such as glycol or other cooling fluids to and from the cooling media reservoir 46. The bladder pump 46 may be fluidly connected to the cooling media reservoir 46 such as through fluid connections 54, 56. One or more one way valves or check valves 52 may be used so that oscillation of the ice maker 30 as it oscillates or rocks back and forth along arrow 42 imparts motion to the bladder pump 46 thereby compressing and relieving the bladder. Thus, one or more check valves 52 may be used to create a circular flow within the bladder bath and to and from the cooling media reservoir 46. The check valves or one way valves 52 limit the direction of the fluid flow between chambers 62, 64 of the bladder pump 46. Thus, the check valves prevent fluid from flowing backwards thus reserving fluid and pressure in the desired direction so as to a circulate fluid through the bladder pump 46.

Figure 5A:
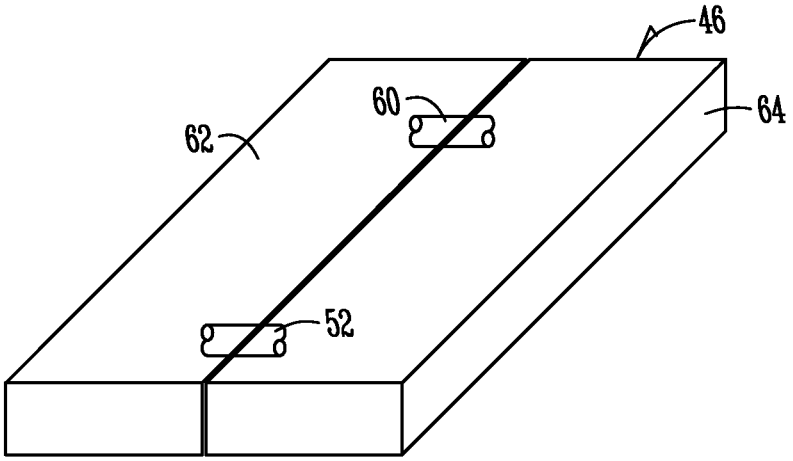
FIG. 5A-5D illustrate operation of the bladder pump.
Figure 5B:
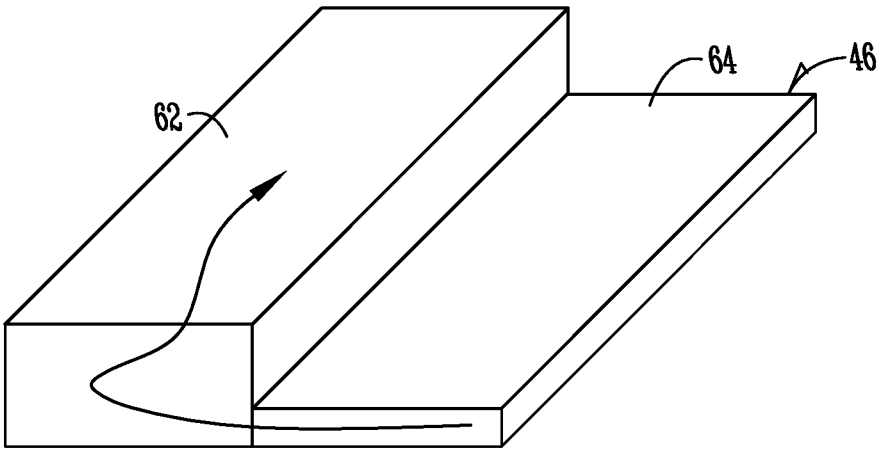
Figure 5C:
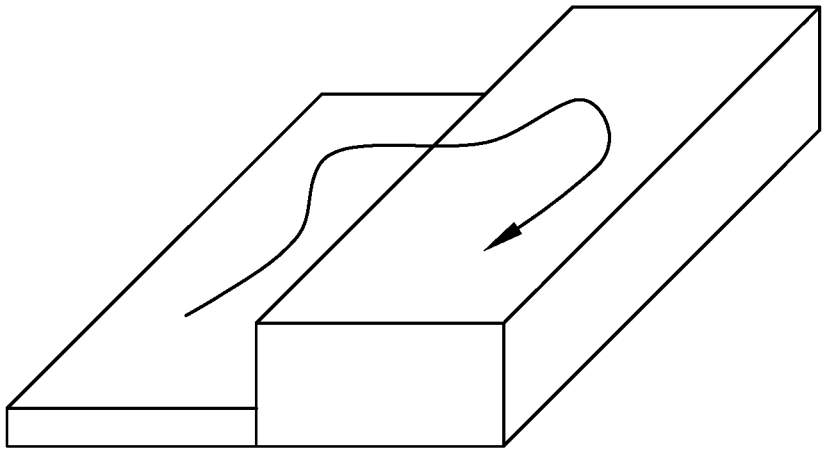
Figure 5D:
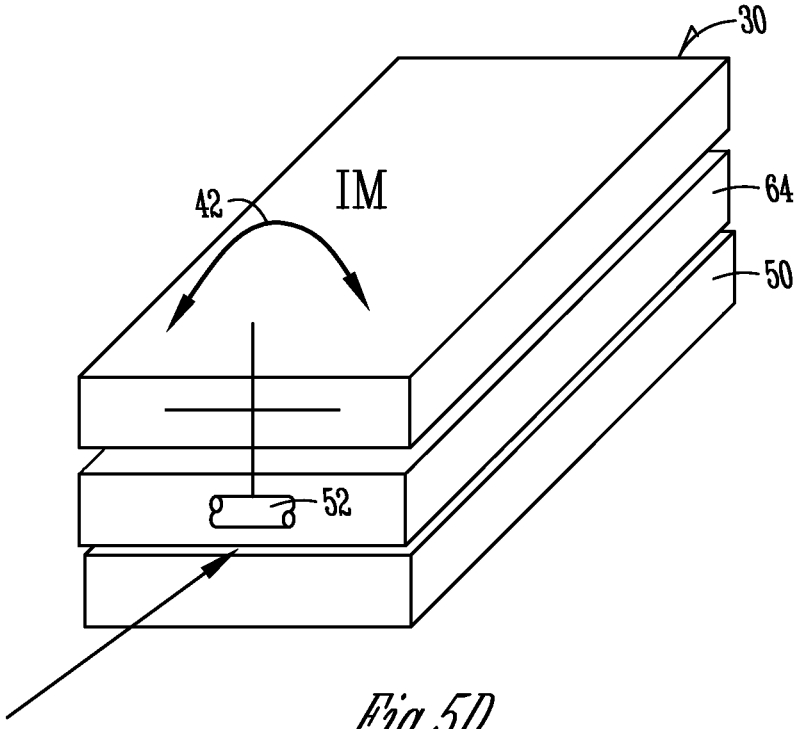

FIG. 5A through 5D show another example of the movement of cooling media. FIG. 5A illustrates the bladder pump 46 with check valves 52, 60 to circulate fluid from first side 62 of the bladder pump 46 to a second side 66 of the bladder pump 46. FIG. 5B and FIG. 5C further illustrate circulation of the fluid within the bladder pump 46 is accomplished by cyclical compression of the bladder 46 combined with the check valves 52,60. FIG. 5D illustrates the ice maker 30, bladder pump 46, and TEC or cold sink 50. In this embodiment, the bladder pump 46 has two chambers. These chambers are provided with valving 50 so as to direct the flow of the cooling media in a circular direction. As an example, a first valve 63 may be placed at first opening 64 of first side 62 so as to drive the flow of cooling media from the first side 62 to the second side 66. Additionally, a second valve 67 may be placed at second opening 68 so as to as to drive the flow of cooling media from the second side 66 to the first side 62. This would drive the fluid in a circular motion allowing for circulation of the fluid.

One skilled in the art will appreciate that additional chambers and valves can be provided and configured to allow for a circular flow of the cooling media. Besides providing chambers, one skilled in the art will appreciate that one or more fluid conduits can be included to allow for circular flow of the cooling media within the bladder pump 46, through the conduits, to a cooling source such as cold sink 50 as discussed prior, or to one or more points of cooling. These conduits may provide for flow through a cooling media reservoir 48, or simply to one or more points of cooling and then provide for flow back to bladder pump 46.

One advantage provided is that a single power source, in this case a motor providing rocking motion to an ice maker can also be used for pumping. Thus, the need to separately power both a motor and a pump is eliminated or omitted while still maintaining needed functionality of circulating cooling fluid to freeze ice and providing oscillation to the ice maker for freezing the ice.

Figure 6:
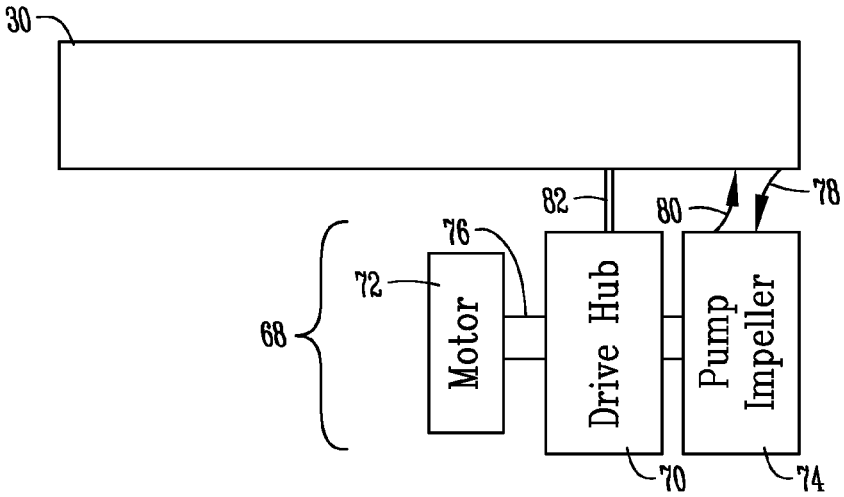
FIG. 6 illustrates using motor drive output to provide rocking motion to an ice maker and also drive a pump.

Alternatively as shown in FIG. 6, a single motor drive output may provide the rocking motion to an ice maker and also drive a pump. Thus, a single motor drive output may be used to both create rocking motion within the ice maker and drive a pump to circulate cooling fluid. The ice maker 30 is shown in FIG. 6 with an assembly 68 positioned beneath the ice maker. The assembly 68 includes a drive hub 70, a motor 72, and a pump impeller 74 connected along a drive shaft 76 for circulating cooling fluid. A drive link 82 is operatively connected between the drive hub 82 and the ice maker 30. Fluid lines 78, 80 are connected between the ice maker 30 and the pump impeller 74. In operation, a motor drive output provides for both applying rocking motion to the ice maker 30 and driving the pump to circulate cooling fluid. Thus, rotation of the drive shaft 76 through operation of the motor 72 both provides rocking motion to the ice maker and drives a pump impeller 74.

Figure 7A:
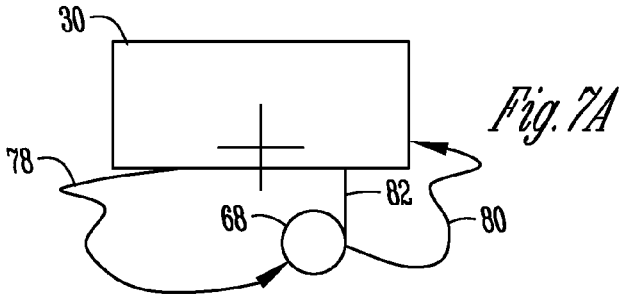
FIG. 7A-7C further illustrate providing rocking motion to an icemaker with a motor drive output which is also used to drive a pump.
Figure 7B:
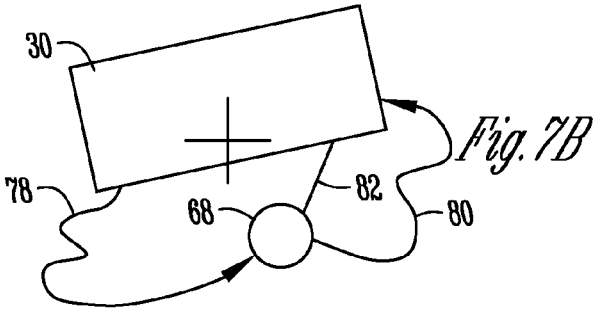
Figure 7C:
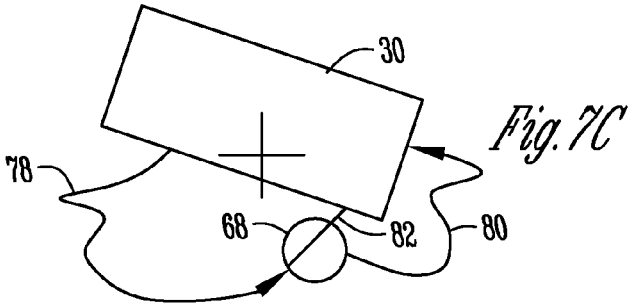

FIG. 7A-7C further illustrate providing rocking motion to an icemaker with a motor drive output which is also used to drive a pump. Note that the assembly 68 is used to drive the link 82 to impart the rocking motion while also driving a pump to provide fluid flow by circulating fluid through fluid lines 78, 80. Thus, as shown in FIG. 7A, the drive link 82 is in a first position and as the drive link 82 rotates around the assembly 68, as shown in FIG. 7B and FIG. 7C, the ice maker 30 rocks back and forth. As the ice maker 30 rocks back and forth, cooling fluid is pumped or circulated through the ice maker 30.

Figure 8:
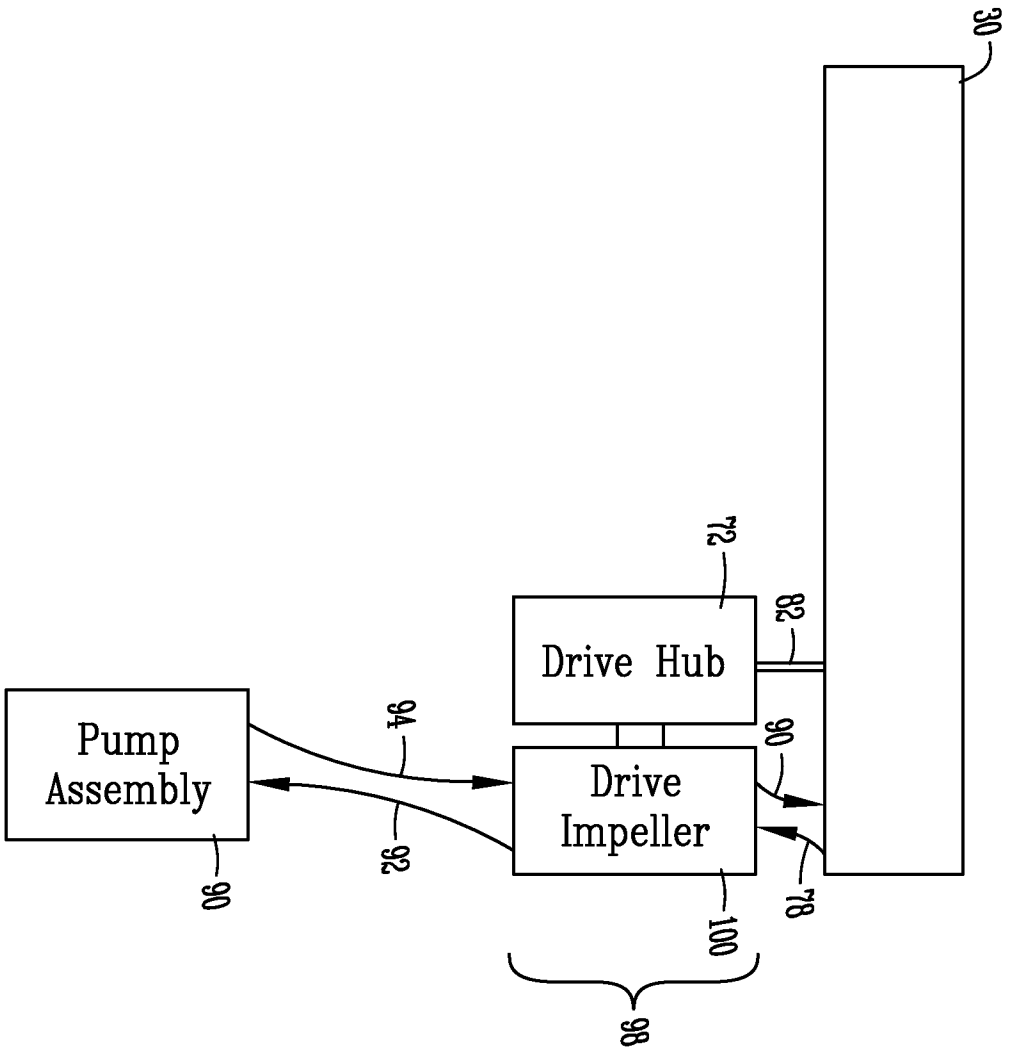
FIG. 8 illustrates using a powered pump within a water system to create rocking motion for an ice maker.

FIG. 8 illustrates using a powered pump within a water, glycol or other fluid system to create rocking motion for an ice maker. In FIG. 8, an assembly 98 includes a drive hub 70 and drive impeller 100 connected along a drive shaft 76. A pump assembly 90 is operatively connected to the drive impeller through fluid lines 92, 94. The drive impeller is fluidly connected to the ice maker through fluid lines to the drive impeller 100. As the pump assembly 90 circulates fluid through the fluid lines 78, 80 of the ice maker 30, the drive impeller 100 rotates the drive hub 72 and in turn the drive link 82 to provide rocking motion to the ice maker 30.

Figure 9A:
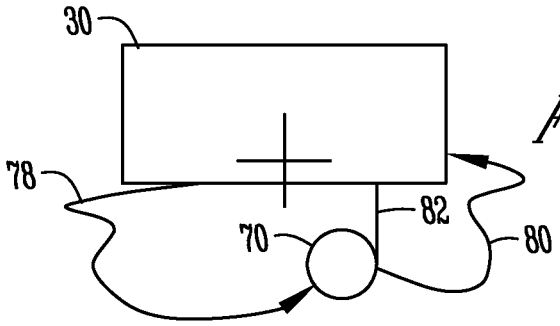
FIG. 9A-9C further illustrate the rocking motion of an icemaker as provided by a powered pump within the water system.
Figure 9B:
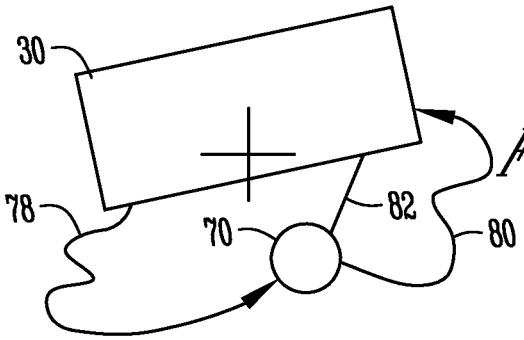
Figure 9C:
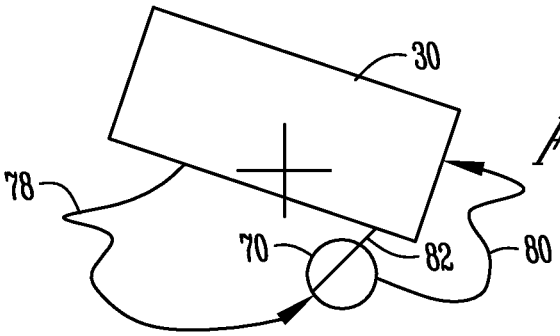

FIG. 9A-9C further illustrate the rocking motion of an icemaker as provided by a powered pump within the water system. Note that the powered pump within the fluid system is used to create rocking motion of the ice maker.

Thus, a single power source may be used to both provide rocking or oscillating motion to an ice maker and to power a pump for circulating cooling fluid. Thus, the oscillating motion created by a motor may be used to pump fluid. Alternatively, the pumping of fluid may be used to drive a motor to provide oscillating motion, or alternatively the same motor may be used to both drive a pump and create oscillating motion.

Therefore, a refrigerator has been disclosed which can use a single power source to provide a rocking motion to an ice maker while also providing power for circulating fluid. Although specific embodiments have been shown and described the present invention, the present invention is not to be limited to the specific embodiments shown and described. The present invention contemplates numerous options, alternatives including, without limitation, the configuration of the refrigerator, the type of cooling system used for the ice maker, the type of fluid used, the manner in which a single power source is used to provide for motion and pumping.

What is claimed is:

1. A refrigerator, comprising:

a refrigerator cabinet;

an ice maker disposed within the refrigerator cabinet;

a pump fluidly connected to the ice maker and configured for pumping cooling media to the ice maker;

a motor operatively connected to the ice maker and configured to provide oscillating movement to the ice maker;

wherein the pump is operatively connected to the motor such that driving of the motor results in the pumping of the cooling media with the pump; and wherein the pump is an oscillation pump comprising a bladder, a first check valve and a second one way check valve and positioned such that oscillation of the icemaker compresses and relieves the bladder in a cyclical manner.

2. The refrigerator of claim 1 further comprising a drive link between the motor and the ice maker.

3. The refrigerator of claim 2 further comprising a drive hub operatively connected between the motor and the drive link.

4. The refrigerator of claim 1 wherein the cooling media comprises water, glycol, or salt brine.

5. The refrigerator of claim 1 further comprising a cooling media reservoir fluidly connected to the bladder.

6. The refrigerator of claim 5 further comprising a thermoelectric cooler in contact with the cooling media reservoir.

7. The refrigerator of claim 6 further comprising a cold sink in contact with the cooling media reservoir.

8. A refrigerator, comprising:

a refrigerator cabinet;

an ice maker disposed within the refrigerator cabinet;

an oscillation pump comprising a bladder in contact with the ice maker;

one way check valves associated with the bladder;

a cooling media reservoir fluidly connected to the bladder;

wherein the ice maker is configured to oscillate thereby compressing and relieving the bladder in a cyclical manner;

wherein the movement of the ice maker creates a circular flow of fluid in the bladder and moves fluid from the bladder to and from the cooling media reservoir.

9. The refrigerator of claim 8 wherein the fluid is cooling media.

10. The refrigerator of claim 9 wherein the cooling media comprises water, glycol, or salt brine.

11. The refrigerator of claim 8 further comprising a thermoelectric cooler in contact with the cooling media reservoir.

12. The refrigerator of claim 8 further comprising a cold sink in contact with the cooling media reservoir.

13. A method of using motion of an ice maker of a refrigerator to power flow of cooling media, the method comprising:

providing a refrigerator having a refrigerator cabinet, an ice maker disposed within the refrigerator cabinet, and an oscillation pump comprising a bladder, a first check valve and a second one way check valve and positioned such that oscillation of the icemaker compresses and relieves the bladder in a cyclical manner;

using oscillation of the icemaker to power the flow of the cooling media by compressing and relieving the bladder to create a circular flow of the cooling media within the bladder.

14. The method of claim 13 wherein the step of using oscillation further creates a circular flow of the cooling media to and from a cooling media reservoir.

15. The method of claim 14 wherein the refrigerator further comprises a thermoelectric cooler in contact with the cooling media reservoir.

16. The method of claim 15 further comprising cooling the cooling media within the cooling media reservoir using the thermoelectric cooler.

17. The method of claim 14 wherein the refrigerator further comprises a cold sink in contact with the cooling media reservoir.

18. The method of claim 17 further comprising cooling the cooling media within the cooling media reservoir using the cold sink.

* * * * *